US005406986A

United States Patent [19]

Oda et al.

[11] Patent Number: 5,406,986

[45] Date of Patent: Apr. 18, 1995

[54] FAULTY WEFT SEPARATING APPARATUS IN A RAPIER LOOM FOR MULTIPLE COLORS

[75] Inventors: Kiyoyasu Oda; Akihiko Yamamoto, both of Kanazawa, Japan

[73] Assignee: Tsudakoma Kogyo Kabushiki Kaisha, Kanazawa, Japan

[21] Appl. No.: 128,658

[22] Filed: Sep. 30, 1993

[30] Foreign Application Priority Data

Oct. 2, 1992 [JP] Japan ..... 4-264952

[51] Int. Cl.[6] ..... D03D 51/08; D03D 47/34

[52] U.S. Cl. ..... 139/116.2; 139/450; 139/453

[58] Field of Search ..... 139/116.2, 453, 450, 139/170.3, 170.4

[56] References Cited

U.S. PATENT DOCUMENTS

| | | | |
|---|---|---|---|
| 4,143,683 | 3/1979 | Scheidecker | 139/453 |
| 4,191,222 | 3/1980 | Mitchell . | |
| 4,729,411 | 3/1988 | Ellenberger et al. | 139/116.2 |
| 4,858,656 | 8/1989 | Suwa . | |
| 5,090,454 | 2/1992 | Pierson et al. . | |
| 5,158,120 | 10/1992 | Kaufmann et al. | 139/450 |
| 5,199,468 | 4/1993 | Aarts et al. | 139/450 |

FOREIGN PATENT DOCUMENTS

| | | |
|---|---|---|
| 0332257 | 9/1989 | European Pat. Off. . |
| 0446150 | 9/1991 | European Pat. Off. . |
| 61-245339 | 10/1986 | Japan . |
| 62-177258 | 8/1987 | Japan . |

*Primary Examiner*—Andrew M. Falik

*Attorney, Agent, or Firm*—Oblon, Spivak, McClelland, Maier, & Neustadt

[57] ABSTRACT

A faulty weft separating apparatus in a rapier loom for multiple colors which separates a faulty weft from other normal wefts and removes the faulty weft by way of a weft removing apparatus when a faulty weft insertion occurs. A set of guiding members are disposed on the insertion side of a fabric and when a weft is inserted properly, the guiding members are located at the retraction position to store the inserted weft in a storage section. When a faulty weft insertion occurs, the guiding members swing to the fabric winding side to allow the faulty weft to enter a positioning section, thus separating the faulty weft from other normal wefts. The separated faulty weft is picked up by a hook and wound by a weft removing apparatus.

10 Claims, 17 Drawing Sheets

FAULTY WEFT SEPARATING APPARATUS IN A RAPIER LOOM FOR MULTIPLE COLORS

BACKGROUND OF THE INVENTION

1. Field of the Invention

The present invention relates to a faulty weft separating apparatus in a rapier loom for multi-color yarns which separates a weft which remains in a continuous state with a faulty weft from other normal wefts to remove the faulty weft from a shed via a weft removing apparatus when a faulty weft insertion occurs, thereby enabling the faulty weft to be removed.

2. Description of the Related Art

Japanese Patent Laid open No. 62-177258 (U.S. Pat. No. 4,858,656) has disclosed a weft removing apparatus for a jet loom which automatically removes a faulty weft (which means the weft resulting from a faulty weft insertion) from the shed and restarts a loom when a faulty weft insertion occurs.

The apparatus according to this invention has a winding drum from which a lever is protruded to be disposed on the insertion side of a fabric. The rear portion of a faulty weft is caught by the lever and the winding drum Is driven to pull the faulty weft, thus winding the faulty weft around the drum so that the faulty weft which is beaten in cloth fell can be removed out of the shed. When a faulty weft insertion occurs, the loom inhibits a weft cutter from cutting the rear portion of the faulty weft and inhibits a new weft insertion during braking the loom, thus stopping the loom. After the loom stops, the shedding motion is reversed to pick find for the faulty weft and then the weft removing apparatus is actuated. Because the faulty weft remains in a continuous state with a weft supply package when the faulty weft is exposed in the shed, the weft removing apparatus is capable of catching the faulty weft easily by hooking it.

Although the apparatus according to the prior art causes no problem when it was used in a Jet loom, when such an apparatus was applied to a rapier loom for multiple colors, it is difficult to securely catch only the faulty weft, so that it is not possible to complete the weft removing operation. That is, in a rapier loom for multiple colors, normally, the weft to be inserted is selectively carried in front of an inserting rapier by means of a weft selecting finger, and until the weft is caught by the inserting rapier, the rear portion of the weft is not cut off, so that the weft remains in a continuous state with the weft supply package. Thus, when the loom stops due to a faulty weft insertion, the rear portion of the faulty weft is placed at almost the same position as the rear portions of the other wefts which have been inserted properly in the vicinity of cloth fell on the insertion side, making it difficult to distinguish the faulty weft from the properly inserted wefts and thus difficult to catch only the faulty weft.

SUMMARY OF THE INVENTION

Accordingly, an object of the present invention is to provide a faulty weft separating apparatus in a rapier loom for multiple colors, which is capable of separating only the weft which remains in a continuous state with a faulty weft, that is, separating the rear portion of the faulty weft from other wefts, and catching and removing the faulty weft when a faulty weft insertion occurs, by providing multiple combined guiding members on the insertion side of fabric.

Another object of the present invention is to provide such an apparatus which is capable of pulling the faulty weft apart from cloth fell when removing the faulty weft to prevent the faulty weft from being cut in the shed, thereby making the faulty weft removing operation smooth.

According to the present invention, there is provided an apparatus containing a set of multiple combined guiding members which are mutually moved relative to each other between the end of the insertion side of fabric and a weft removing apparatus, which includes a storage area which stores an inserted weft and positions it at a specified position, a guiding section which guides an inserted weft into the storage area when the weft is beaten by a reed, and a blocking section which blocks the rear portion of the faulty weft from being moved to the storage area.

The guiding member can have a positioning section which positions the rear portion of a faulty weft caught by the blocking section on the warp yarn feeding side.

The guiding member may form a driving section which moves the rear portion of a faulty weft caught by the blocking section or the positioning section to the warp yarn feeding side.

According to the structure of the present invention, multiple guiding members are mutually moved relative to each other, to form a storage section, a guiding section and a blocking section. When a weft is inserted properly, the guiding member stores the rear portion of the inserted weft in the storage section via the guiding section so as to position the weft at a specified position to prepare for the next weft insertion. On the other hand, when a faulty insertion occurs, the guiding member blocks the rear portion of the faulty weft, that is, the weft which is continuous with the faulty weft from moving to the storage section by means of the blocking section, separating the weft which is continuous with the faulty weft from other wefts. Then, the weft removing apparatus is capable of catching only the separated faulty weft by means of a lever mounted on a winding drum and removing the faulty weft from the shed.

In case that the guiding member forms the positioning section, the faulty weft is caught by the blocking section when a faulty weft insertion is detected, and after the loom completely stops the faulty weft can be transferred to the positioning section and removed by means of the weft removing apparatus via the positioning section. So the faulty weft can be separated sufficiently from a weft cutter until the loom has stopped, thereby preventing the weft cutter from cutting the faulty weft by mistake.

In case that the guiding member forms a driving section, the guiding member is capable of moving the rear portion of the faulty weft positively to the warp yarn feeding side via the driving section. Thus, the faulty weft can be separated positively in the shed from cloth fell to the warp yarn feeding side. Consequently, when removing the faulty weft, the amount of tension to be applied to the faulty weft can be small, thus preventing the faulty weft from being cut during the removing of the faulty weft.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
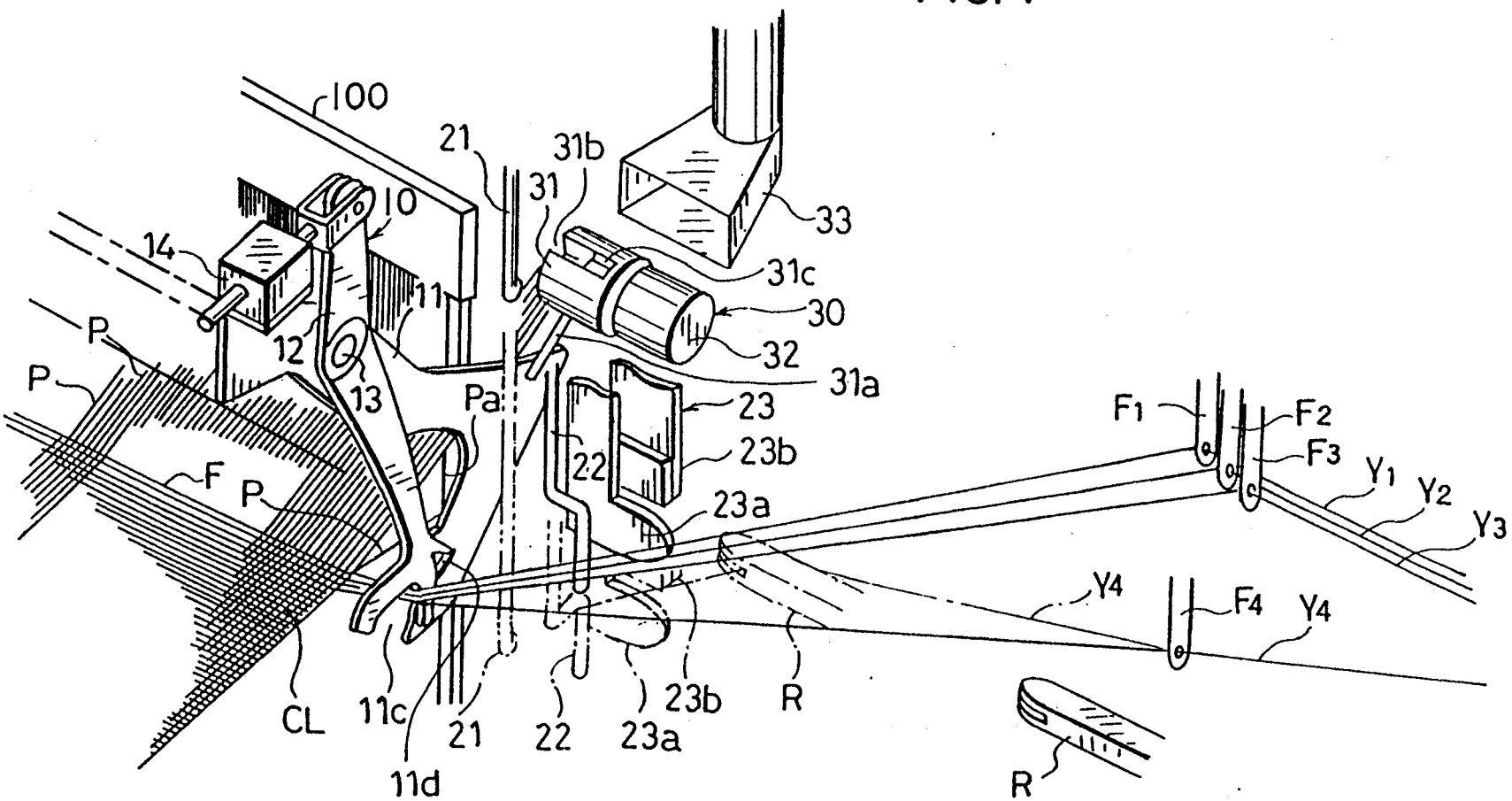
FIG. 1 is a perspective view showing the entire structure of a first embodiment of the present invention.

Referring to FIG. 1, a faulty weft separating apparatus 10 (hereinafter referred to as a separating apparatus) in a rapier loom for multiple colors comprises guiding members 11, 12 and is disposed between the end of fabric CL and a weft removing apparatus 30 at the insertion side of fabric CL.

Assuming that the loom is a rapier loom for multiple colors which inserts weft Yi (i=1, 2, . . . ) selectively according to a specified insertion pattern via an inserting rapier R and the weft Yi is selected by a selecting finger Fi (i=1, 2 . . . ), that is, when the selecting finger Fi is located upward at a non-selecting position the weft Yi is not caught by the inserting rapier R, so that the weft Yi is not inserted into a shed Pa formed by the warp P. When the selecting finger Fi descends to a selecting position downward and is carried in front of the inserting rapier, the weft Yi is caught by the inserting rapier R and then inserted into the shed Pa. The inserted weft Yi is beaten to a cloth fell F by means of a reed 100, forming fabric CL together with the warp P.

Figure 2:
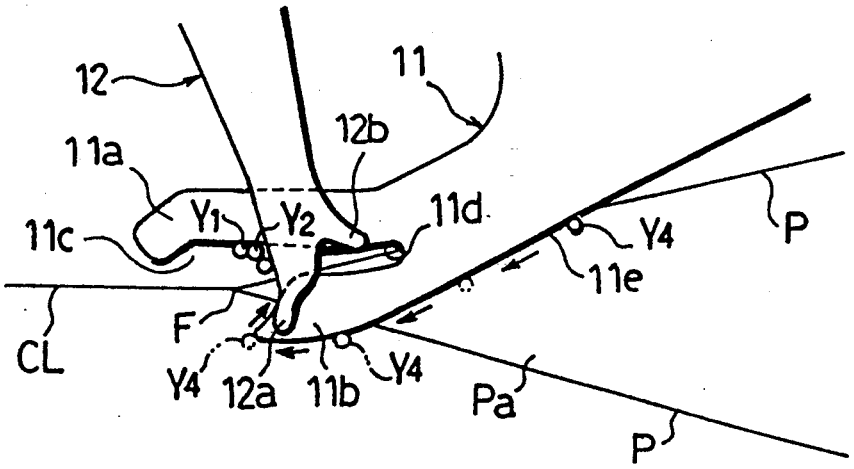
FIG. 2 is an explanatory view illustrating the operation of the first embodiment.

The guiding member 11 is a plate member disposed parallel to the warp P and has upper and lower protruded sections 11*a*, 11*b* respectively, which protrude substantially horizontally from the warp yarn feeding side (which means the warp P side) toward the fabric winding side (which means fabric CL side) (FIG. 2). The upper protruded portion 11*a* is higher than fabric CL, extending beyond the cloth fell F up to the fabric winding side and the front end of the upper protruded portion is bent slightly downward. The lower protruded portion 11*b* is lower than fabric CL, extending nearly up to the vicinity of the cloth fell F. A recess 11*c* which is open widely to the fabric winding side, facing slightly downward, is formed between the upper and lower protruded portions 11*a*, 11*b*, and an indentation 11*d* which extends deeply to the yarn feeding side is formed in the innermost portion of the recess 11*c*. The lower side 11*e* of the guiding member 11 is curved obliquely so it is smoothly continuous up to the front end of the lower protruded portion 11*b*.

The guiding member 12 is disposed adjacent to the guiding member 11 (FIG. 1) and axially slidably connected to the guiding member 11 via a pin 13. An electromagnetic solenoid 14 which swings the guiding member 12 parallel to the guiding member 11 is mounted on the top end of the guiding member 11.

A protruded portion 12*a* facing downward and a protruded portion 12*b* directed backward so it faces obliquely downward, are formed at the lower end of the guiding member 12 (FIG. 2). The protruded portion 12*a* must not extend beyond the lower side 11*e* of the guiding member 11. When the guiding member 12 is swung and retracted to the warp feeding side by shortening the plunger of the electromagnetic solenoid 14, the protruded portion 12*a* must be located slightly backward of the front end of the lower protruded portion 11*b* of the guiding member 11, relative to the warp feeding side.(FIG. 2). At this time, the protruded portion 12*b* must be located above the indentation 11*d* of the guiding member 11. On the other hand, when the guiding member 12 is swung to the fabric winding side by extending the plunger of the electromagnetic solenoid 14, the protruded portion 12*a* moves to the fabric winding side relative to the front end of the lower protruded portion 11*b* (FIG. 3) so as to form a narrow passage 11*c*1 between the protruded portion 12*a* and the lower protruded portion 11*b* and at the same time, the protruded portion 12*b* descends below the indentation 11*d* (FIG. 3), blocking the entrance of the indentation 11*d*. In other words, the guiding member 12 can be located at the retraction position shown in FIG. 2 or at the separation position shown in FIG. 3 by contracting or extending the plunger of the electromagnetic solenoid 14, respectively.

Further, a hook 21, a yarn guide 22, a weft cutter 23 and a weft removing apparatus 30 are disposed on the insertion side of fabric CL (FIG. 1).

The hook 21 is disposed so as to face downward and may be situated at the upper retraction position (indicated by a solid line in FIG. 1) or at the lower hooking position (indicated by a double-dotted and dashed line in FIG. 1). The yarn guide 22 is a bent rod in the form of a crank. The yarn guide 22 may be located at the upper retraction position (indicated by the solid line in FIG. 1) and advanced downward so as to be at the position where the upper portion of the bent part is rotated by about 90° to the fabric winding side relative to the front end (indicated by a single-dotted and dashed line in FIG. 1). The weft cutter 23 comprises a fixed blade 23*a* and a movable blade 23*b*. The fixed and movable blades 23*a*, 23*b* ascend and descend together with the yarn guide 22, and may be located at the upper retraction position (indicated by a solid line in FIG. 1) or the lower action position (indicated by a single-dotted and dashed line in FIG. 1). The movable blade 23*b* is capable of independently moving further downward when the fixed and movable blades 23*a*, 23*b* are located at the action position to cut the weft Yi which is nipped between the fixed blade 23*a* and the movable blade 23*b*.

The weft removing apparatus 30 is disposed above the fabric CL and is constituted mainly of a winding drum 31, a motor 32 which drives the winding drum 31 and a suction nozzle 33 which is open to the winding drum 31. A lever 31a is mounted on the circumference of the winding drum 31. A groove 31*b* is formed axially in the winding drum 31 and a slide cutter 31*c* is encased in the groove 31*b*. The above weft removing apparatus is well known with reference to the prior technical reference aforementioned.

When the loom is operated normally, the plunger of the electromagnetic solenoid 14 of the separating apparatus 10 is contracted, so that the guiding member 12 is located at the retraction position shown in FIG. 2. The hook 21 is located at the upper retraction position and the weft removing apparatus 30 is not actuated. On the other hand, the yarn guide 22 and the weft cutter 23 are each placed at the upper retraction position and the lower action position, each time a weft is inserted. As for the selecting finger Fi, each time a weft is inserted, only the selecting finger corresponding to a specific weft Yi descends to the selecting position according to the specified insertion pattern while the other selecting fingers remain at their non-selecting upward positions.

Now, assume that a weft Y4 is to be inserted (FIG. 1). First, the selecting finger F4 which corresponds to the weft Y4 descends to its selecting position and then the inserting rapier R starts advancing. At the same time, the yarn guide 22 and the weft cutter 23 descend to their action positions. Thus, the weft Y4 caught by the inserting rapier R is bent by the .yarn guide 22 which is located at its action position (as indicated by a single-dotted and dashed line in FIG. 1) accompanied by the advancement of the inserting rapier R and introduced so as to enter in between the fixed blade 23*a* and the movable 23*b* of the weft cutter 23 which is located at the action position. The selecting finger F4 is returned to its non-selecting position at the same time when the inserting rapier R catches the weft Y4. Then, if only the movable blade 23*b* of the weft cutter descends to cut the weft Y4, the inserting rapier R advances catching the front end of the cut weft Y4, thereby inserting the weft Y4 into the shed Pa.

When insertion of the weft Y4 is completed, the inserting rapier R retracts to its original position outside of the shed and the reed 100 beats the weft Y4 against the cloth fell F. At this time, the rear portion of the inserted weft Y4 remains continuous up to a weft supply package not shown via the selecting finger F4. At the insertion side of fabric CL. The weft Y4 advances along the lower side 11*e* of the guiding member 11 (direction indicated by the arrow in FIG. 2) while the reed advances and when beating by the reed is completed, the weft Y4 goes across the front end of the lower protruded portion 11*b* of the guiding member 11, so that it can be positioned in the recess 11*c* of the guiding member 11. At this time, the connection of the recess 11*c* and the indentation 11*d* is intercepted innermost by the guiding member 12. Therefore, the weft Y4 can be positioned together with other wefts Yi ($i \neq 4$) inserted previously at a specified position in a small area partitioned mainly by the front edge of the guide member 12 and the lower edge of the upper protruded portion 11*a*.

At this time, the recess 11*c* acts as the storage area for the inserted weft for positioning the weft Yi together with the guiding member 12. The lower side 11*e* of the guiding member 11 acts as a guide for introducing Inserted weft Yi to the storage area when the weft is beaten by the reed.

Assume that the weft Yi positioned in the recess 11*c* in the above manner does not interfere with the yarn guide 22 located at the retraction position and the weft cutter 23 located at the retraction position as long as the selecting finger Fi is located at the non-selecting position. The yarn guide 22 pushes down the weft yarn Yi, selected by the selecting finger Fi by means of the bent part, to the same height as the advancement path of the inserting rapier R when the yarn guides 22 descends to its action position. Consequently, the yarn guide 22 positions the weft Yi together with the selecting finger Fi positioned at the selecting position, in front of the inserting rapier R. Then, the weft cutter 23 is placed at its action position, the same height as the inserting rapier R, so as to cut the weft Yi which is introduced and advanced by the inserting rapier R. After the weft cutter 23 cuts the weft Yi, the yarn guide 22 and the weft cutter 23 retract to their original position immediately.

Consider the case when insertion of the weft Y4 fails for some reason.

Figure 3:
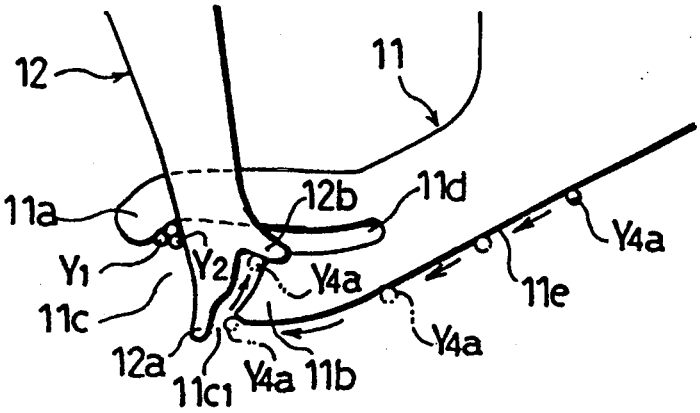
FIG. 3 is an explanatory view illustrating the operation of the first embodiment.

When a faulty weft insertion occurs, a weft feeler (not shown) transmits a faulty weft insertion signal, so that the plunger of the electromagnetic solenoid 14 of the separating apparatus 10 is extended corresponding to the faulty weft insertion signal, driving the guiding member 12 to its separating position (FIG. 3). The weft Y4, that is, the rear portion of the faulty weft Y4*a*, slides along the lower side 11*e* of the guiding member 11 (in the direction indicated by the arrow in FIG. 3) while being beaten by the reed and extends beyond the front end of the lower protruded portion of the guiding member 11. Then, the weft Y4*a* enters in a passage 11*c*1 formed by the protruded portion 12*a* of the guiding member 12 and the front end of the lower protruded portion 11*b*, and is kept in the vicinity of the entrance of the indentation 11*d* of the guiding member 11 by the protruded portion 12*b* of the guiding member 12 (FIG. 3).

That is, the passage 11*c*1 with the protruded portion 12*b* of the guiding member 12 act as a blocking section for blocking the faulty weft Y4*a* from moving to the storage area.

On the other hand, the loom automatically stops after a rotation by inertia of about 1 cycle because the faulty weft insertion signal is present. During this rotation, the selecting finger Fi is inhibited from being actuated, thereby preventing a new weft Yi from being inserted subsequent to the faulty weft Y4*a*. After the yarn guide 22 and the weft cutter 23 take their normal action positions, they retract to the retraction positions, and the weft cutter 23 only idles because there is no weft Yi to be cut. The inserting rapier also idles.

Figure 4:
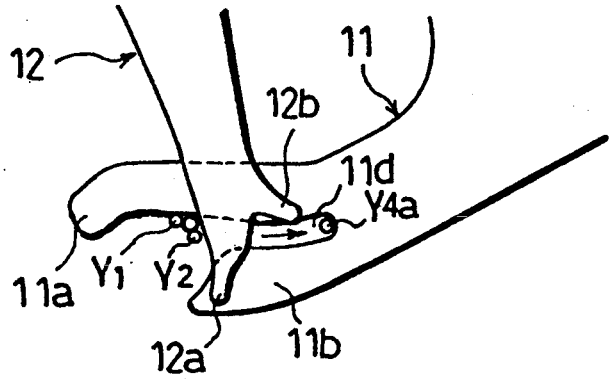
FIG. 4 is an explanatory view illustrating the operation of the first embodiment.

When the loom stops completely, the plunger of the electromagnetic solenoid 14 is contracted so as to retract the guiding member 12 to its retraction position (FIG. 4). The faulty weft Y4*a* which has been caught by the protruded portion 12*b* in the vicinity of the indentation 11*d* is released from being caught by the protruded portion 12*b* and moved in the direction which reduces tension of the faulty weft Y4*a*, that is, to the warp feeding side (the direction Indicated by the arrow in FIG. 4), and enters the indentation 11*d*, so that the faulty weft Y4*a* is completely separated from the other wefts Yi. Namely, the protruded portion 12*b* temporarily blocks the faulty weft Y4*a* from entering the indentation 11*d*, and after the loom stops completely subsequent to the rotation by inertia, permits the faulty weft Y4*a* to enter the indentation 11*d*. Thus, the indentation 11*d* acts as an area for positioning the faulty weft Y4*a* caught by the passage 11*c*1 which acts as a blocking section, on the warp feeding side.

Figure 5:
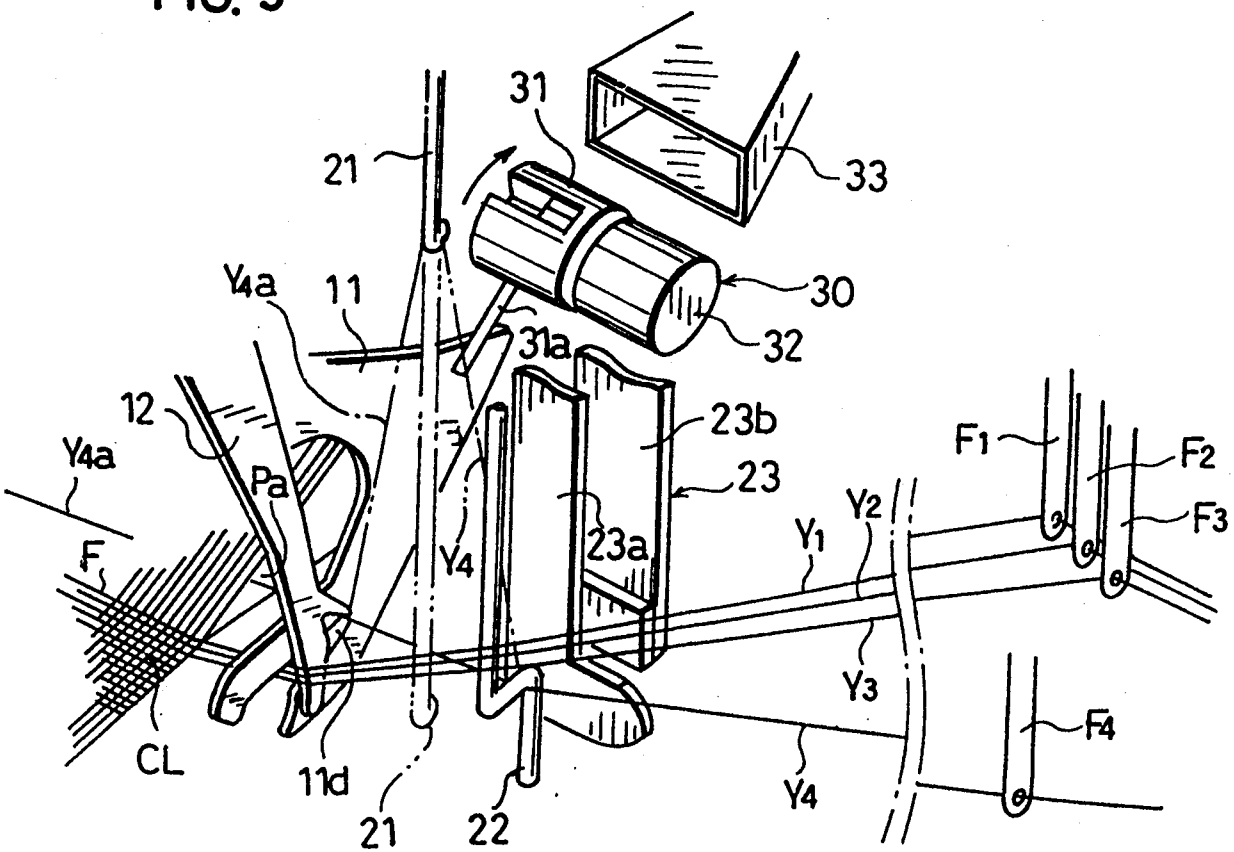
FIG. 5 is an explanatory view illustrating the operation of the first embodiment.
Figure 6:
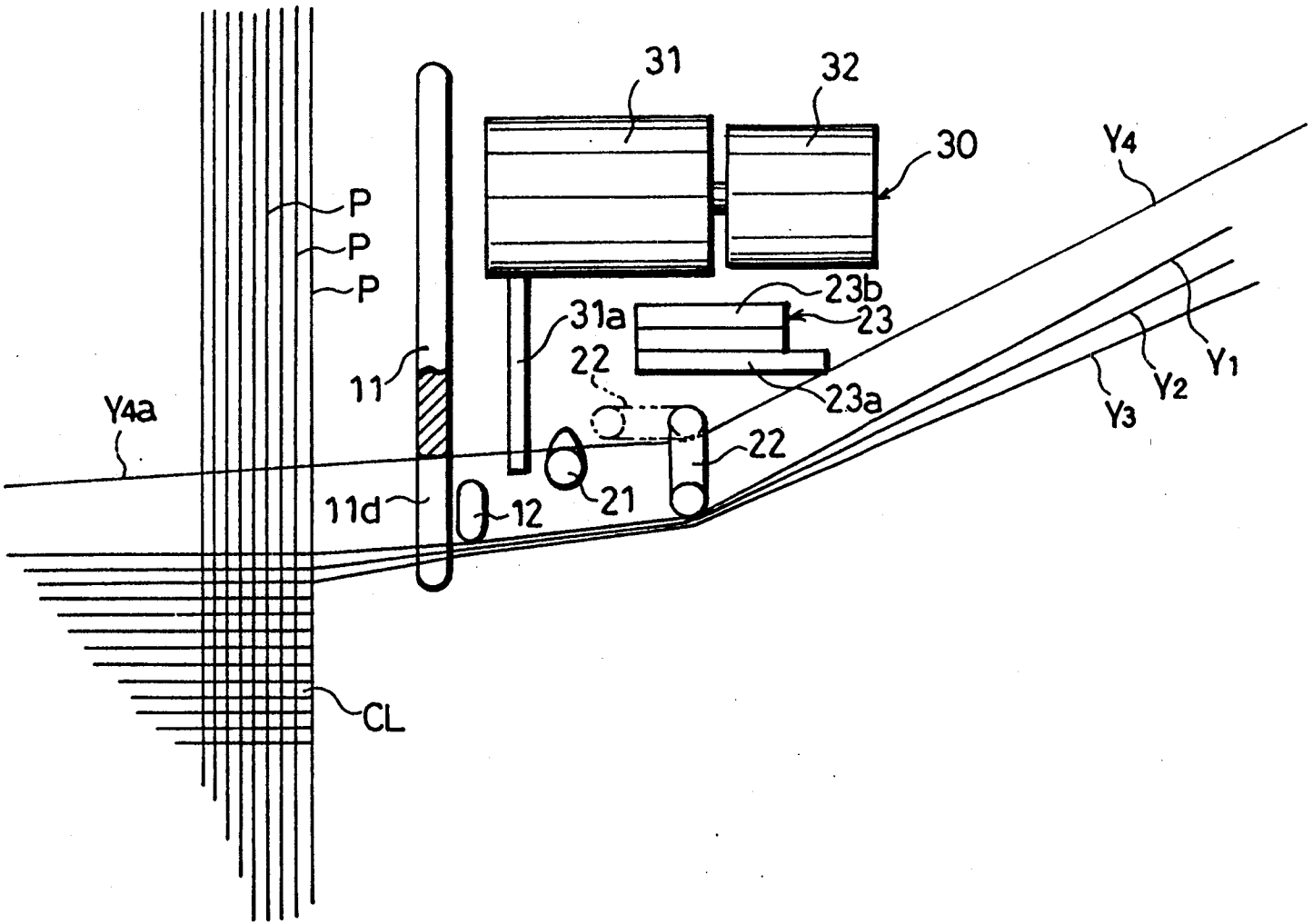
FIG. 6 is an explanatory view illustrating the operation of the first embodiment.

Next, the loom reverses its shedding motion by a pick finder and the faulty weft Y4*a* is exposed in the shed Pa. The selecting finger F4 corresponding to the faulty weft Y4*a* is forcibly moved to the selecting position (FIG. 5). When the yarn guide 22 and the weft cutter 23 are moved to the action positions (FIG. 5), the yarn guide 22 presses down only the weft Y4 which is continuous to the faulty weft Y4*a*, so that the weft Y4 is positioned appropriately via the indentation 11*d* of the guiding member 11, the yarn guide 22 and the selecting finger F4 (as shown by the solid line in FIG. 5). That is, the weft Y4 is positioned just in front of the hook on the warp feeding side and just below the position where the lever 31*a* of the weft removing apparatus 30 can reach (FIG. 6). The other wefts Yi ($i \neq 4$) remain sufficiently pushed to the fabric winding side by the yarn guide 22 which is located at the action position.

Next, the hook 21 is descended to the hooking position and retracted to the upper retraction position. Consequently the hook 21 picks up the faulty weft Y4*a* and following weft Y4 in the form of a mountain (as shown by the two-dotted and dashed line in FIG. 5). Then, the motor of the weft removing apparatus 30 is started so as to rotate the winding drum in the direction of the arrow in FIG. 5 so that the lever 31*a* catches the picked faulty weft Y4*a* and weft Y4 to wind the faulty weft Y4*a* and the weft Y4 around the winding drum 31. That is, the faulty weft Y4*a* in the shed Pa, which has caused a faulty weft insertion, can be pulled apart from the cloth fell F, wound around the winding drum 31 and removed from the shed Pa. At this time, the same quantity of the weft Y4 is assumed to be supplied from the weft supply package (not shown) via the selecting finger F4. Therefore, the winding drum 31 is capable of winding the faulty weft Y4*a* and the following weft Y4 at the same time.

When the entire length of the faulty weft Y4*a* in the shed Pa is wound around the winding drum 31 (FIG. 7), the loom is restarted. Completion of winding of the faulty weft Y4*a* is detected by means of a detector (not shown) which detects the front end of the faulty weft Y4*a*, or by a timer which measures the rotation time of the winding drum 31 or by a detector which measures the amount of rotations of the winding drum 31.

When the loom is restarted, the inserting rapier R advances to catch the weft Y4 (FIG. 7) and after this, the weft cutter 23 is actuated to cut the weft Y4. The yarn guide 22 and the weft cutter 23 are retracted to their retraction positions. The weft removing apparatus 30 winds the remainder of the weft Y4 extending from the winding drum 31 to the weft cutter 31*c* and then actuates the slide cutter 31*c* to cut the faulty weft Y4*a* and the weft Y4 wound around the winding drum 31 into short pieces. The short pieces can be removed as waste yarn via the suction nozzle 33.

Figure 8:
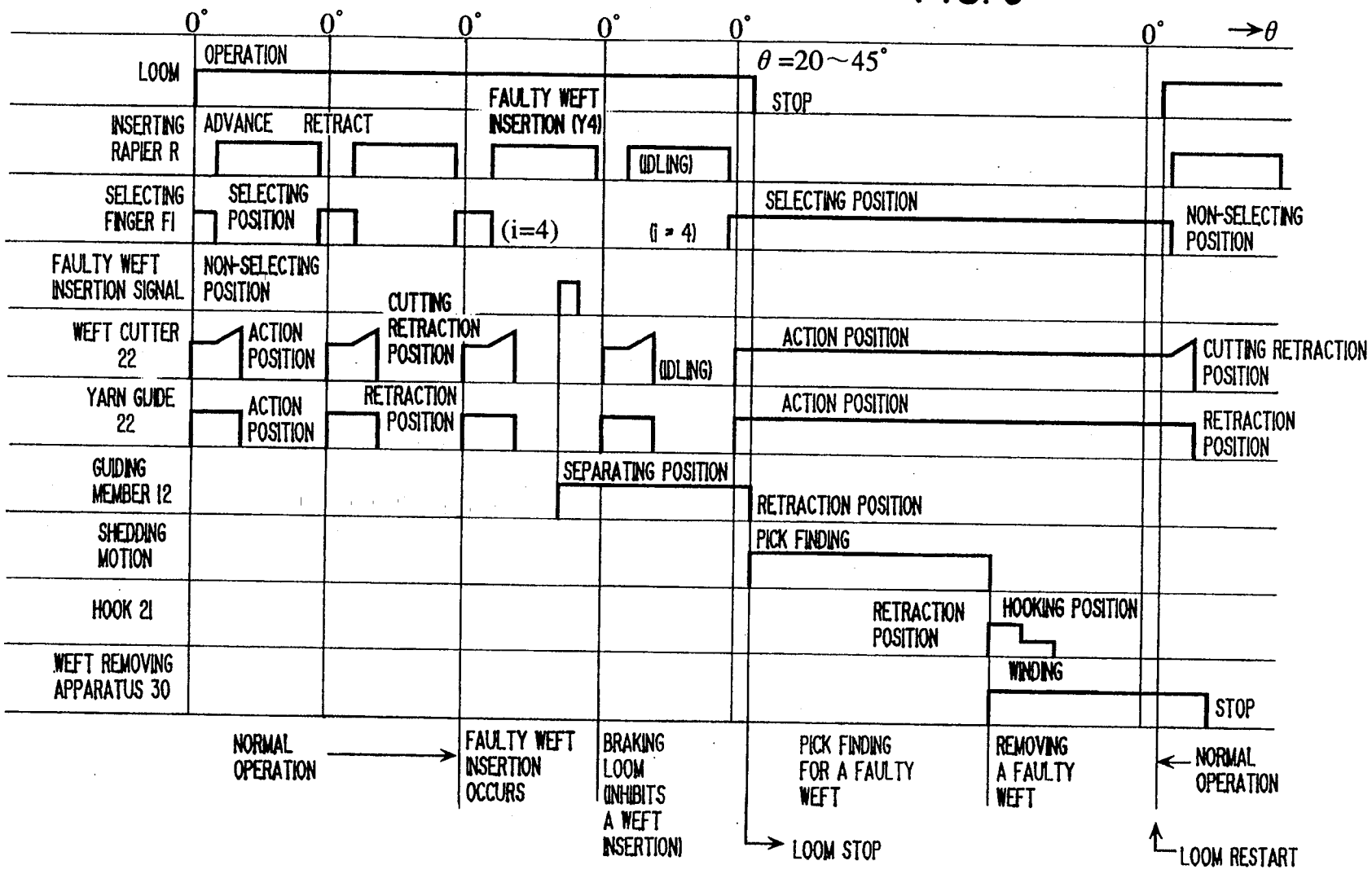
FIG. 8 is a time chart of the first embodiment.

The timing chart of FIG. 8 schematically shows a sequence of the operation of each member. In FIG. 8, the x-axis indicates the crank angle $\theta$ during the operation of the loom and the time axis during a stop. According to FIG. 8, after a faulty weft insertion occurs, it is assumed that the loom stops at $\theta = 20° \sim 45°$ after a rotation by inertia of about 1 cycle. The selecting finger F4 corresponding to the faulty weft Y4*a* and the weft Y4 are moved to the selecting position at the same timing as during normal operation before the loom is stopped. Further, according to FIG. 4, the hook 21 is temporarily stopped for the lever 31*a* of the weft removing apparatus 30 to securely catch the faulty weft Y4*a* and the weft Y4 midway between the hooking position and the retraction position.

The above description also applies when any weft Yi ($i \neq 4$) other than the weft Y4 undergoes faulty weft insertion. The weft Yi may be any number of two or more.

Other Embodiments

Figure 9A:
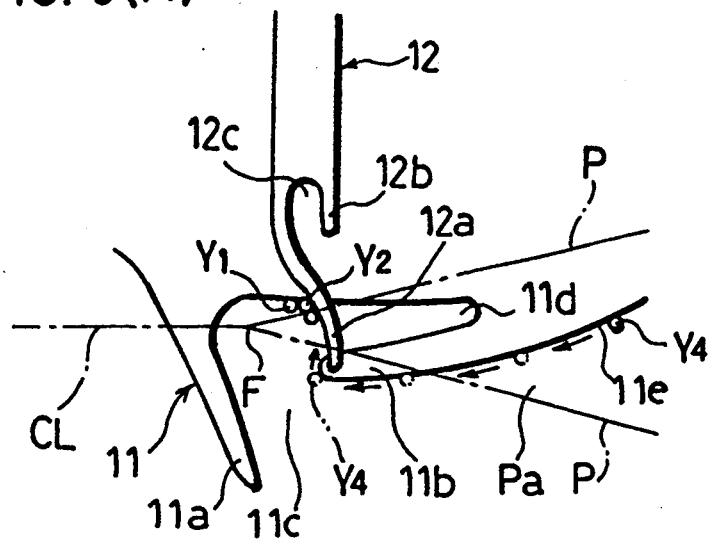
FIGS. 9(A), 9(B) and 9(C) are explanatory views illustrating the operation of the second embodiment.
Figure 9B:
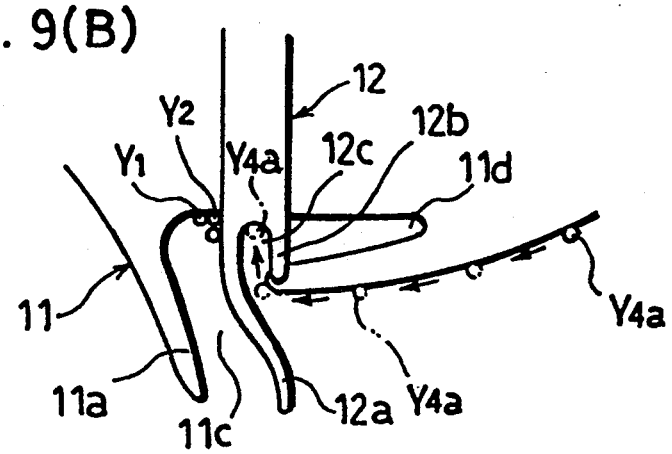
Figure 9C:
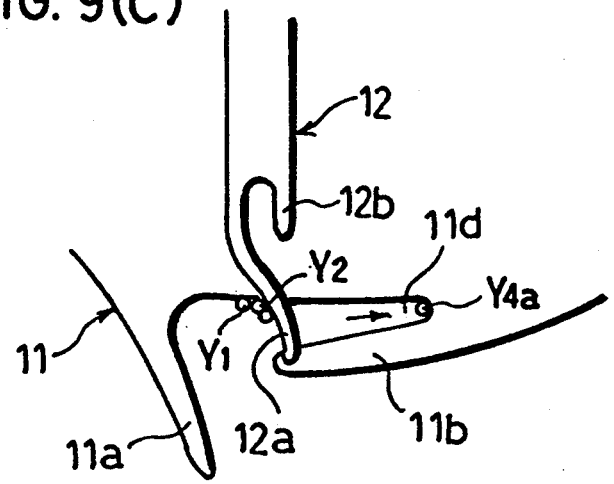

In the guiding member 11 of the separating apparatus 10, the recess 11*c* opening downward and the indentation 11*d* receding deep to the warp feeding side arc formed by the upper protruded portion 11*a* tilted slightly toward the yarn feeding side and the lower protruded portion 11*b* protruding to the fabric winding side (FIG. 9 (A)). On the other hand, in the guiding member 12, the shallow indentation 12*c* opening downward is formed by the protruded portion 12*a* facing downward while curved to the warp feeding side and the protruded portion 12*b* which is shorter, facing downward. The guiding member 12 ascends and descends so that it can be located at the upper retraction position (FIG. 9 (A)) or the lower separation position (FIG. 9 (B)).

The weft Y4 which is inserted properly slides along the lower side 11*e* of the guiding member 11 in the direction indicated by the arrow in FIG. 9 (A) while being beaten by the reed and positioned in the recess 11*c* by means of the front edge of the protruded portion 12*a* of the guiding member 12. The faulty weft Y4*a* is made to enter the indentation 12*c* by driving the guiding member 12 to the separation position (FIG. 9 (B)). When the guiding member 12 is retracted to the retraction position after the loom is stopped, the faulty weft Y4*a* is released from being caught by the protruded portion 12*b*, so that it can enter the indentation 11*d* (in the direction of the arrow in FIG. 9 (C)) and is separated from the other wefts Yi ($i \neq 4$) (FIG. 9 (C)).

The recess 11*c* with the protruded section 12*a* corresponds to the storage area aforementioned. The lower side 11*e* corresponds to the guiding section and the protruded portion 12*c* with the protruded portion 12*b* corresponds to the blocking section. The protruded portion 11*d* corresponds to the positioning section.

Figure 10:
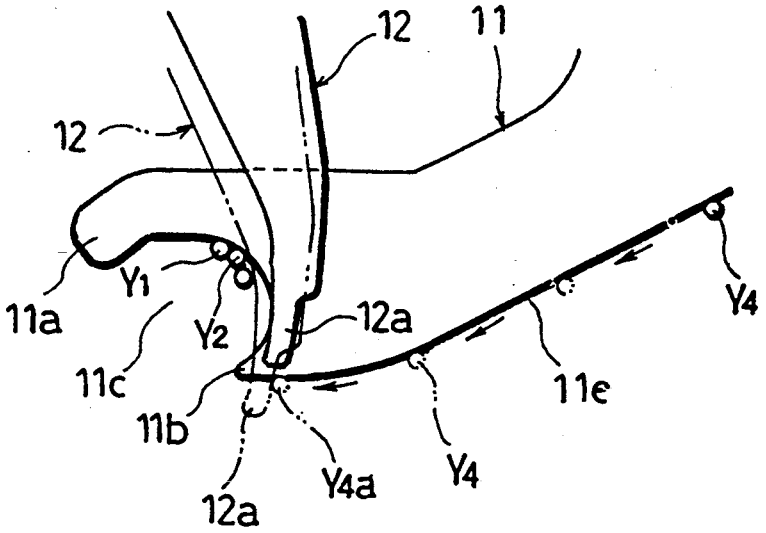
FIG. 10 is an explanatory view illustrating the operation of the third embodiment.

As shown in FIG. 10, the guiding member 11 does not have to have the deep indentation 11*d*. When the guiding member 12, which forms the protruded portion 12*a* protruding downward, is located at the upper retraction position, the protruded portion 12*a* is above the lower protruded portion 11*b* of the guiding member 11 (as shown by the solid line in FIG. 10), the weft Y4 which has been inserted properly slides along the lower side 11*e* corresponding to the guiding section in the direction of the arrow shown in FIG. 10 and can be positioned in the recess 11*c* which corresponds to the storage area. On the other hand, by moving the guiding member 12 downward to the separation position to make the protruded portion 12*a* protrude below the lower protruded portion 11*b* (as shown by the two-dotted and dashed line in FIG. 10), the faulty weft Y4*a* can be prevented from entering in the recess 11*c*. That is, the protruded portion 12*a* corresponds to the blocking portion aforementioned. The faulty weft Y4*a* is returned in a reverse to the arrow in FIG. 10, along the lower side 11*e*, when the reed retracts. Thus, when the loom stops, the faulty weft Y4*a* can be separated from the other wefts Yi (i≠4) which have been inserted properly.

In the embodiment of FIG. 1 aforementioned, the guiding member 11 may be swingable like the guiding member 12.

The guiding members 11, 12 are swingably mounted onto a common bracket 17 via pins 13, 15 so that they may be driven by the electromagnetic solenoids 14, 16. The upper protruded portion 11*a* of the guiding member 11 is short (FIG. 12 (A)) and a hook section 11*f* directed downward is formed at the front end. The guiding member 12 has a long upper protruded portion 12*d* which is directed to the fabric winding side, so that a recess 12*e* is formed between the upper protruded portion 12*d* and the protruded portion 12*a* directed downward.

Figure 12A:
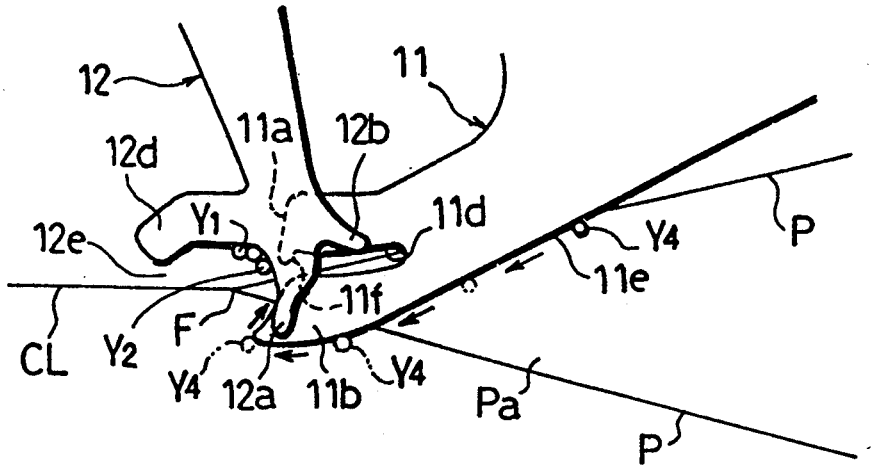
FIGS. 12(A), 12(B), and 12(C) are explanatory views, illustrating the operation of the fourth embodiment.
Figure 12B:
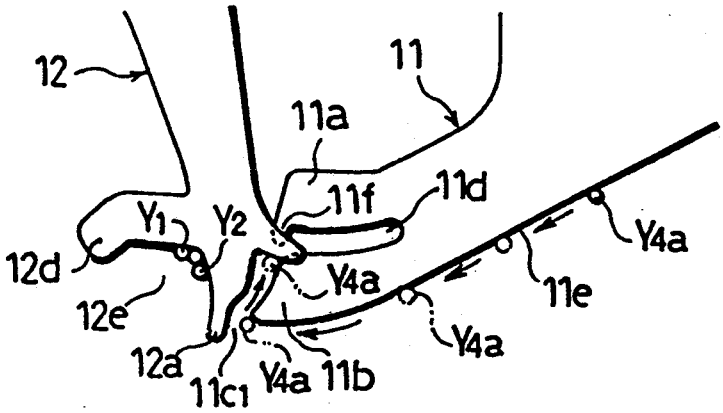
Figure 12C:
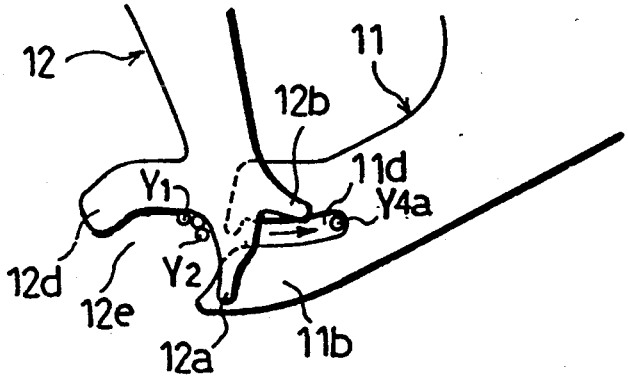

The guiding member 12 may be located at the retraction position shown in FIG. 12 (A) or at the separation position shown in FIG. 12 (B) by contracting or stretching the plunger of the electromagnetic solenoid 14. By contracting and extending the plunger of the electromagnetic solenoid 16, the guiding member 11 may be located at the waiting position, where the upper protruded portion 11*a* and the lower protruded portion 11*b* almost overlap the guiding member 12 which is located at the retraction position, or at the driving position where the guiding member 11 is greatly swung to the weft feeding side, respectively.

Figure 11:
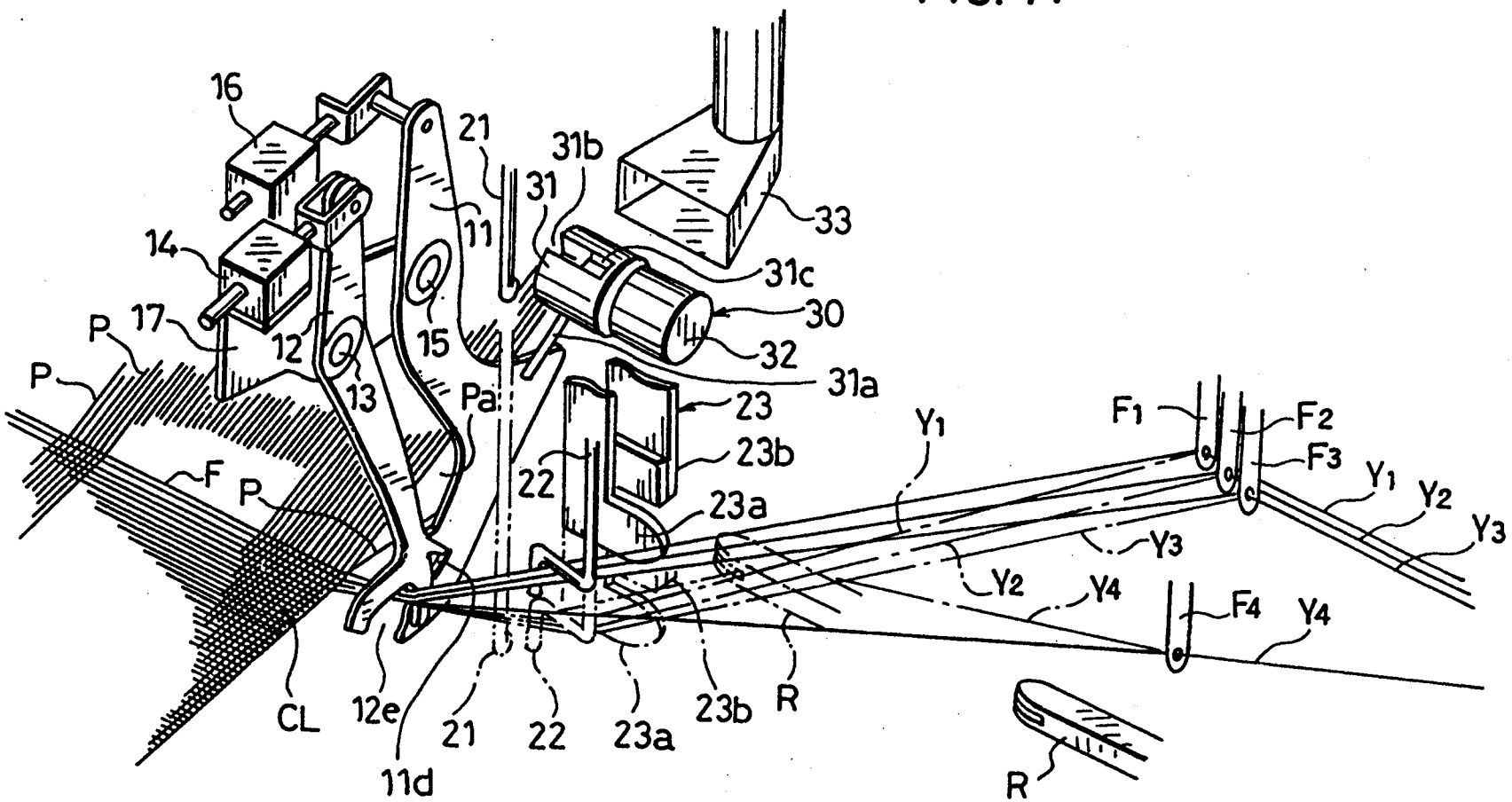
FIG. 11 is a perspective view showing the structure of the fourth embodiment.

If the loom is operated when the guiding members 11, 12 are located at the waiting position and the retraction position, respectively, the weft Yi which has been inserted properly advances along the lower side 11*e* of the guiding member 11 while being beaten by the reed and may be stored in the indentation 12*e* (FIG. 12 (A)). That is, the indentation 12*e* acts as the storage area and the lower side 11*e* acts as the guiding section. The yarn guide 22 ascends and descends between the upper retraction position (indicated by the solid line in FIG. 11) and the lower action position (indicated by the single-dotted and dashed line in FIG. 11) together with the weft cutter 23 while the yarn guide 22 does not rotate. Namely, when the yarn guide 22 descends to the action position, the bent part pushes the weft Yi down entirely between the indentation 12*e* and the selecting finger Fi. Only the weft Y1 corresponding to a specific selecting finger descended to the selecting position is carried in front of the inserting rapier R and inserted.

When the weft Y4 becomes the faulty weft Y4*a*, the guiding member 12 is immediately moved to the separating position (FIG. 12 (B)), and the loom stops. At this time, the rear portion of the faulty weft Y4*a* is made to enter the passage 11*c*1 and caught. Thus, the passage 11*c*1 acts as the blocking section.

Figure 13:
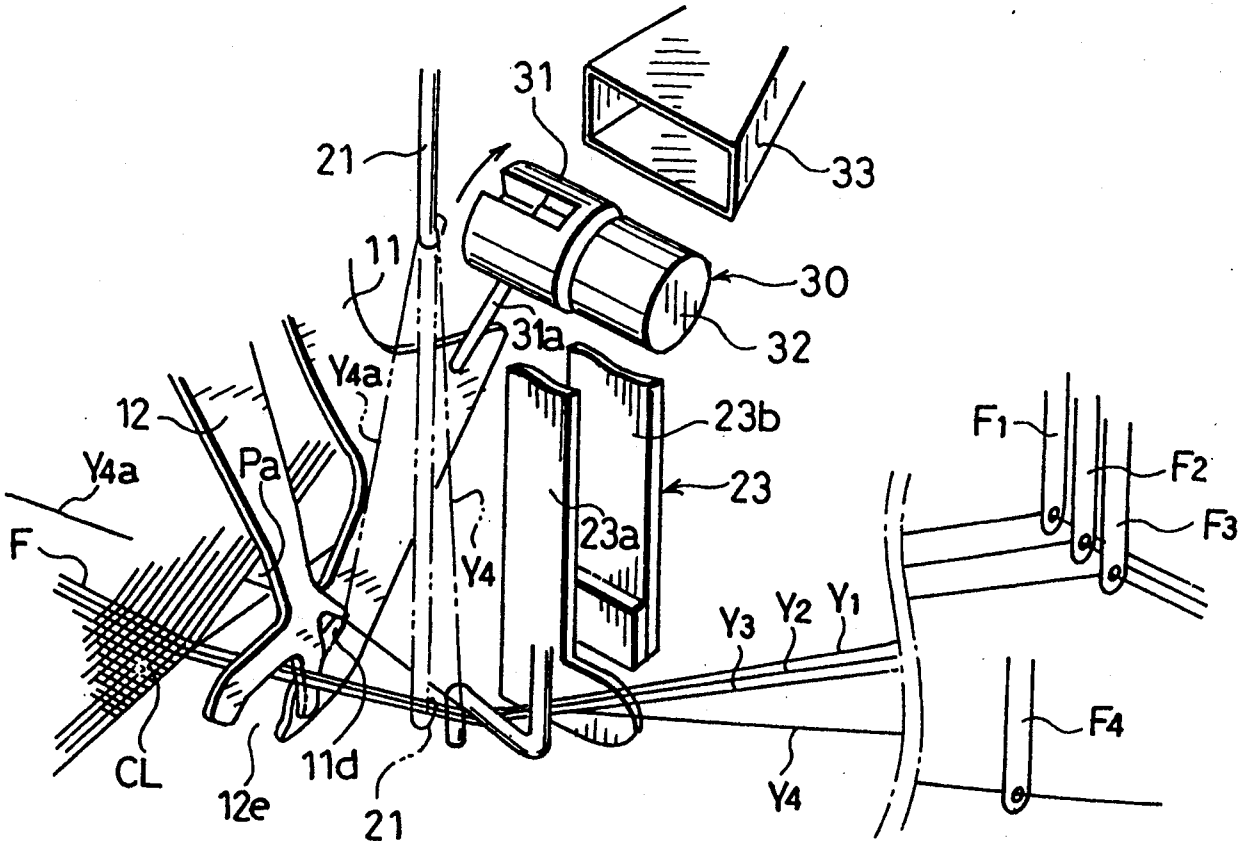
FIG. 13 is an explanatory view illustrating the operation of the fourth embodiment.

When the loom is stopped, the guiding member 12 is retracted to the retraction position (FIG. 12 (C), FIG. 13), the rear portion of the faulty weft Y4*a* is made to enter the recess 11*d* which corresponds to the positioning section aforementioned (in the direction of the arrow as shown in FIG. 12 (C)). After that, the faulty weft Y4*a* is exposed in the shed and the hook 21 is descended to the hooking position (indicated by the two-dotted and dashed line in FIG. 13) and then raised to the retraction position. Consequently, the hook 21 is capable of picking the faulty weft Y4*a* and the following weft Y4 in the form of a mountain (indicated by the two-dotted and dashed line in FIG. 13). The above operation is basically the same as the embodiment of FIG. 1 except that the recess 12*e* of the guiding member 12 corresponds to the storage area aforementioned.

Figure 14:
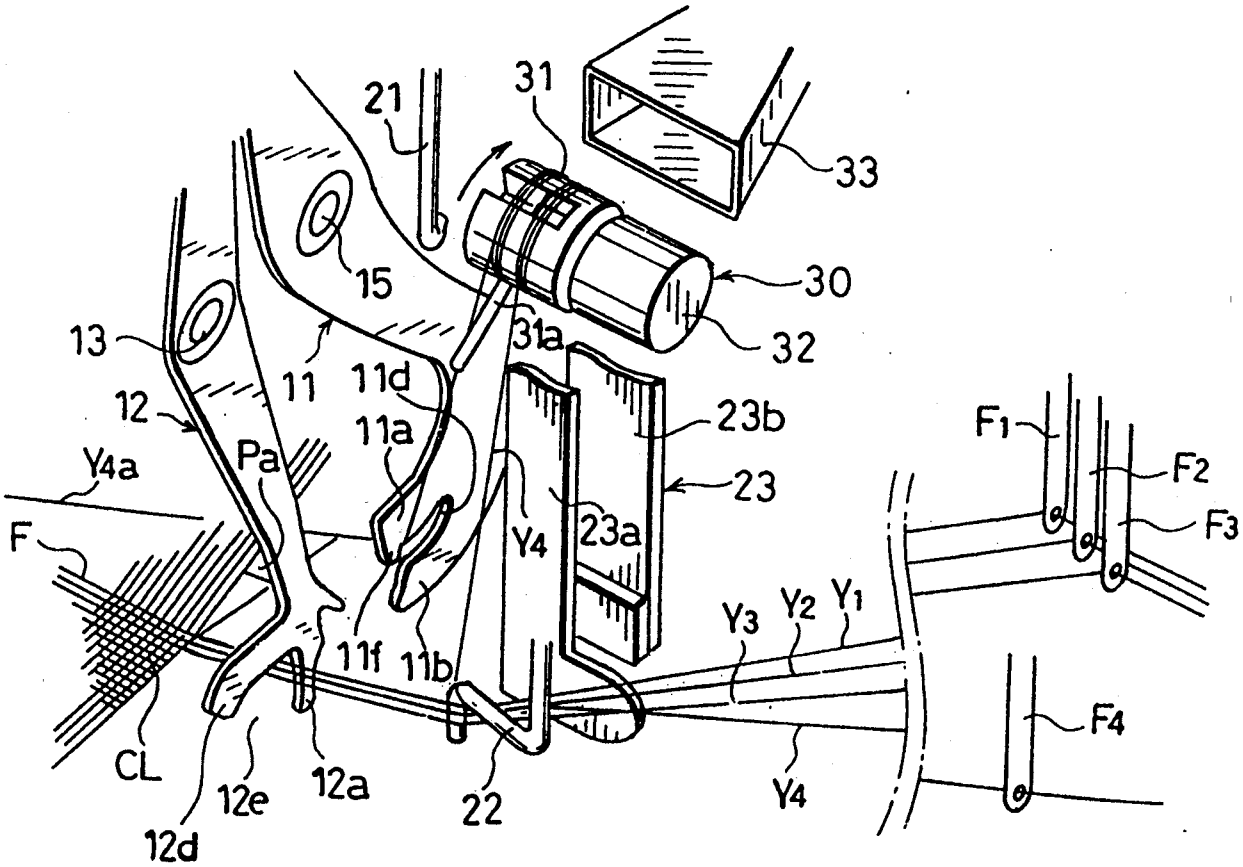
FIG. 14 is an explanatory view illustrating the operation of the fourth embodiment.
Figure 15A:
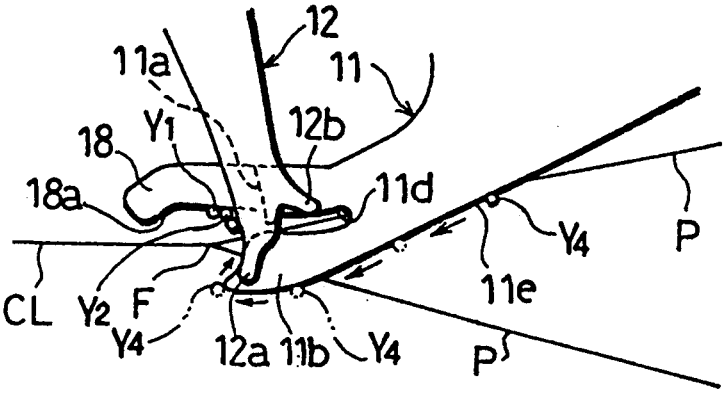
FIGS. 15(A), 15(B), 15(C) and 15(D) are explanatory views illustrating the operation of the fifth embodiment.
Figure 15B:
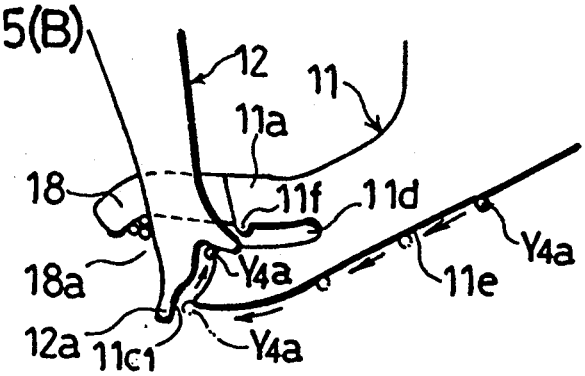
Figure 15C:
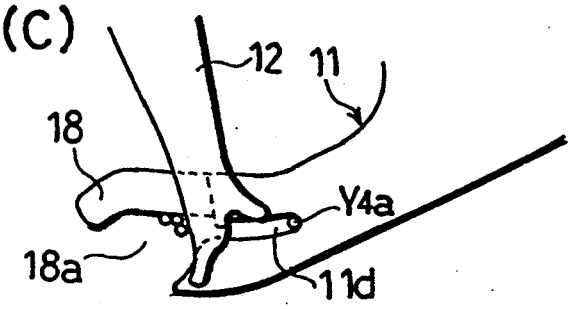
Figure 15D:
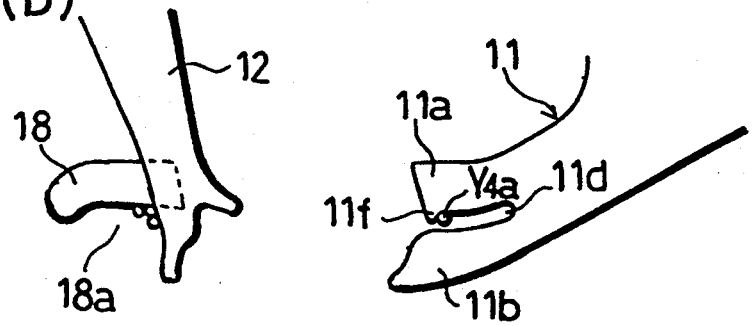

Next, the weft removing apparatus 30 is started. When the lever 31*a* captures the faulty weft Y4*a* and the weft Y4 which are picked up by the hook 21, the guiding member 11 is swung to the driving position (FIG. 14). As a result, the rear portion of the faulty weft Y4*a* which was located in the recess 11*d* is caught by the hook section 11*f* and moved more to the warp feeding side, so that the guiding member 11 is capable of applying a force which separates the faulty weft Y4*a* in the shed from the cloth fell. Because the faulty weft Y4*a* is separated more from the cloth fell F at this time, the faulty weft Y4*a* can be wound around the winding drum 31 of the weft removing apparatus 30 with a very small tension.

The guiding member 11 and the hook section 11*f* form a driving section which moves the rear portion of the faulty weft Y4*a* captured by the recess 11*d* corresponding to the positioning section aforementioned to the warp feeding side. When the entire length of the faulty weft Y4*a* is wound around the winding drum 31, the guiding member 11 which was swung to the driving position may be restored to the waiting position to prepare for restarting the loom. The guiding member 11 may be swung to its driving position before the lever 31*a* catches the faulty weft Y4*a* and the weft Y4, but after the faulty weft Y4*a* is exposed in the shed; it may be before the hook 21 picks up the faulty weft Y4*a* and the weft Y4.

The upper protruded portion 12*d* of the guiding member 12 in the previous embodiment can be substituted by a fixed type guiding member 18 (FIG. 15 (A)--FIG. 15 (D)).

In this case, properly inserted weft Yi is stored in the recess 18*a* formed between the guiding members 12 and 18 (FIG. 15 (A)). The recess 18*a* corresponds to the storage area aforementioned. After the faulty weft Y4*a* is caught by the passage 11*c*1 corresponding to the blocking section (FIG. 15 (B)), it is positioned in the indentation 11*d* corresponding to the positioning section (FIG. 15 (C)). By swinging the guiding member 11 to the driving position, the faulty weft Y4*a* located in the recess 11*d* can be caught by the hook section 11*f*, moved to the warp feeding side and separated from the cloth fell F.

Figure 16:
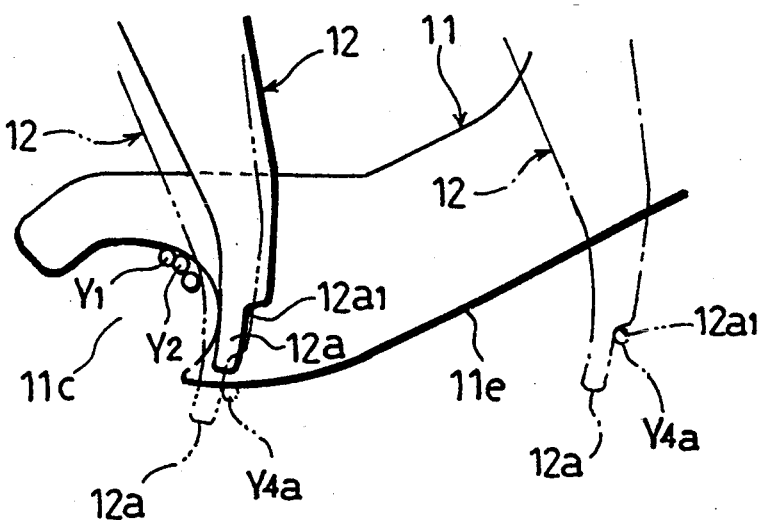
FIG. 16 is an explanatory view illustrating a modified example of the third embodiment.

The guiding member 12 shown in FIG. 10 may be moved to the driving position (indicated by the single-dotted and dashed line in FIG. 16) after it is moved to its separating position (indicated by the two-dotted and dashed line in FIG. 16). By moving the guiding member 12 to the driving position, the faulty weft Y4*a* captured by the protruded portion 12*a* of the guiding member 12 is caught by the stepped portion 12*a*1 of the base of the protruded portion 12*a* and moved to the warp feeding side, so that the faulty weft Y4*a* can be separated from the cloth fell F. At this time, the guiding member 12 and the stepped portion 12*a*1 act as a driving section for moving the rear portion of the faulty weft Y4*a* captured by the protruded portion 12*a* corresponding to the blocking section to the warp feeding side.

Figure 7:
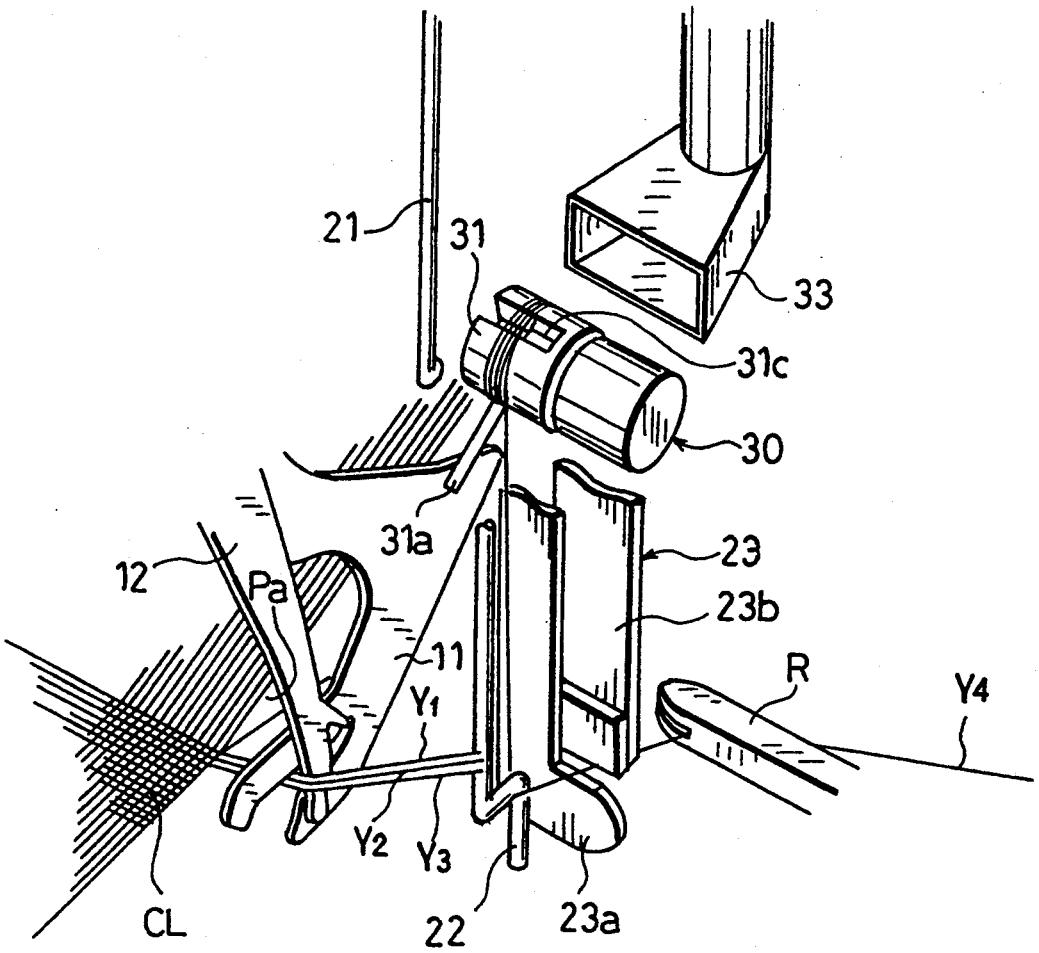
FIG. 7 is an explanatory view illustrating the operation of the first embodiment.
Figure 17:
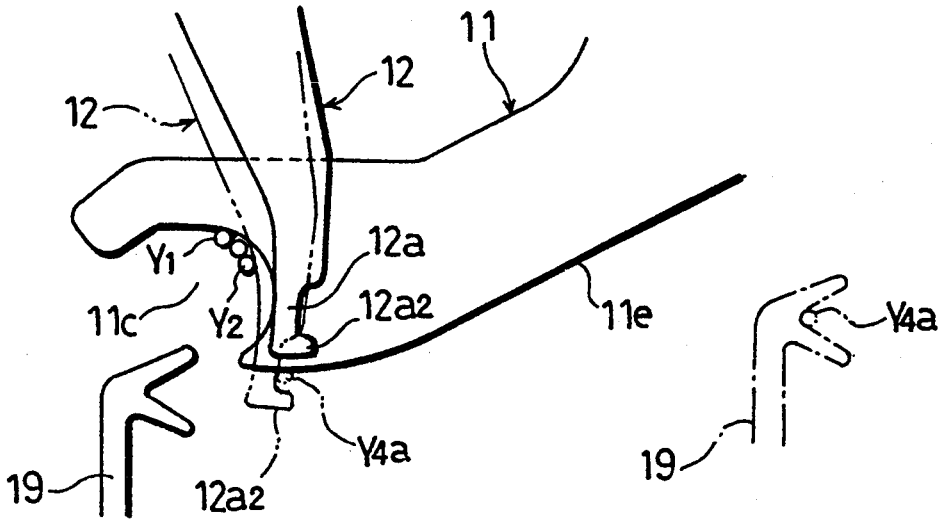
FIG. 17 is an explanatory view illustrating another modified example of the third embodiment.

In the previous embodiment, a third guiding member 19 which corresponds to the driving section can be provided (FIG. 7). In the guiding member 12, a hook 12*a*2 is formed at the front end of the protruded portion 12 so it faces the warp feeding side, and the protruded portion 12*a* and the hook 12*a*2 act as the blocking section which captures the faulty weft Y4*a*. The guiding member 19 is kept at the waiting position apart from the protruded portion 12*a* and the hook 12*a*2 in the fabric-winding-side direction (as shown by the solid line in FIG. 17). When the guiding member 19 is driven to the driving position (shown by the single-dotted and dashed line in FIG. 19), it is capable of moving the faulty weft Y4*a* to the warp feeding side so as to separate the faulty weft Y4*a* from the cloth fell F.

Figure 18A:
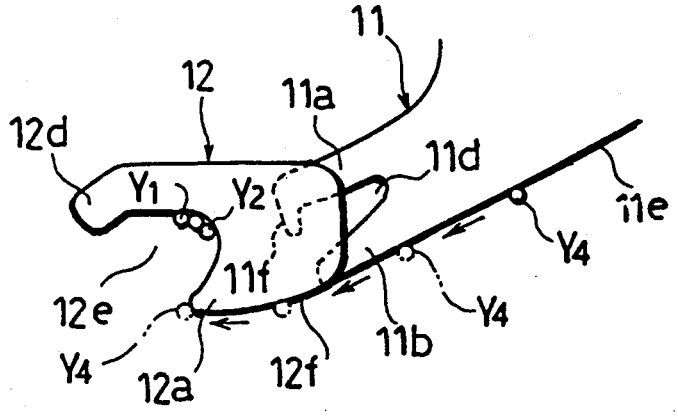
FIGS. 18(A), 18(B) and 18(C) are explanatory views illustrating a modified example of the fourth embodiment.
Figure 18B:
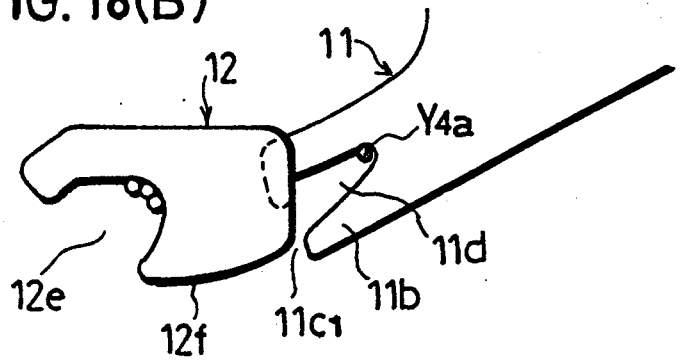
Figure 18C:
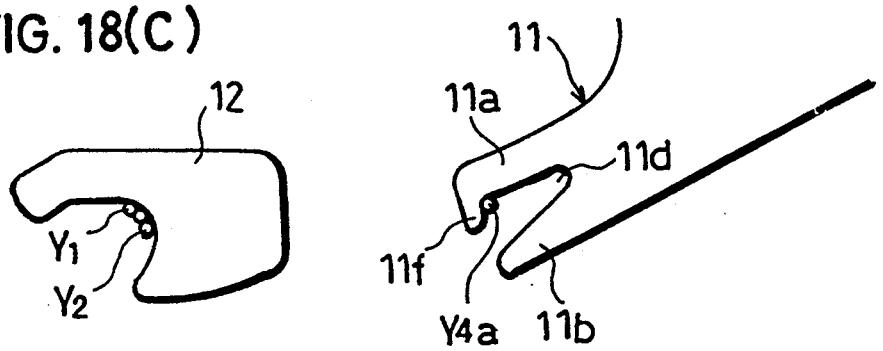

When the guiding member 12 is located at the retraction position, the lower side 12*f* may be in a continuous state with the lower side 11*e* of the guiding member 11 (FIG. 18 (A)–FIG. 18 (C)). The lower sides 11*e* and 12*f* form a guiding section which is capable of introducing the properly inserted weft Yi into the recess 12*e* corresponding to the storage portion (FIG. 18 (A)). The faulty weft Y4*a* may be positioned and captured in the indentation 11*d* via the passage 11*c*1 (FIG. 18 (B)). After that, the faulty weft Y4*a* may be moved to the warp feeding side by the hook 11*f* by driving the guiding member 11 to the driving position (FIG. 18 (C)).

Figure 19A:
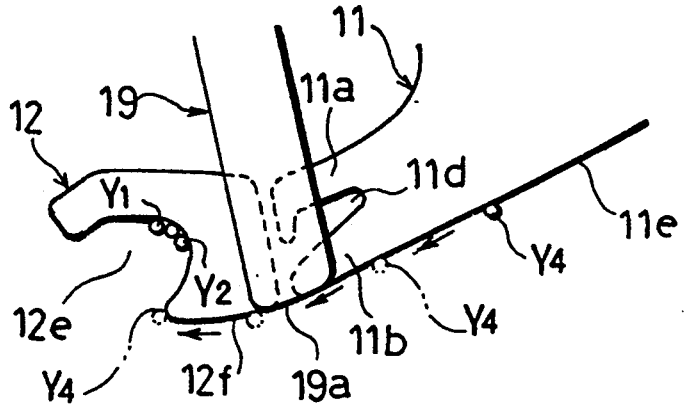
FIGS. 19(A), 19(B) and 19(C) are explanatory views illustrating another modified example of the fourth embodiment.
Figure 19B:
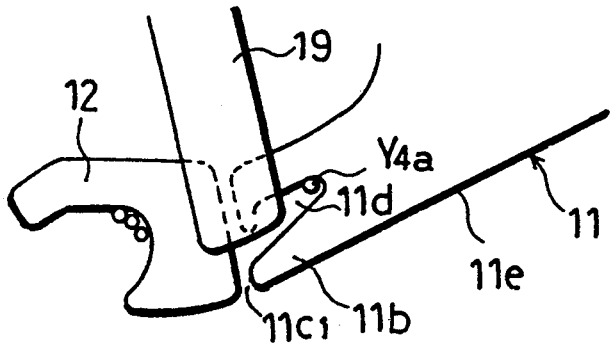
Figure 19C:
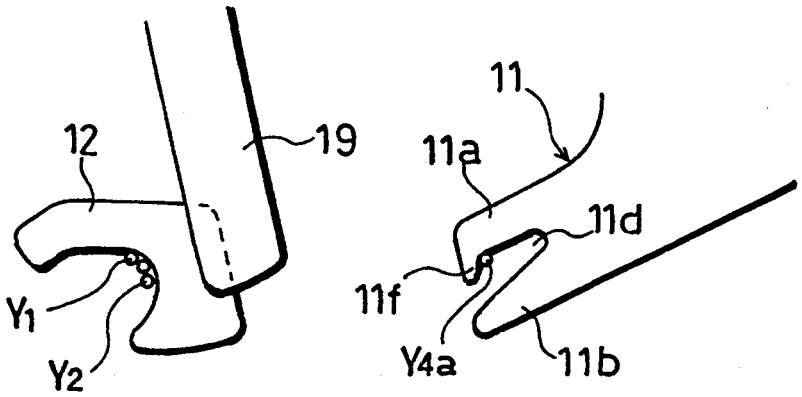

In this embodiment, it is permissible to fix the guiding member 12 and place the third guiding member 19 between the guiding member 12 and the guiding member 11 which is located at the waiting position (FIG. 19 (A)–FIG. 19 (C)). The guiding member 19 may be in the retraction position (FIG. 19 (A)) where the lower side 19*a* remains in a continuous state with the lower sides 11*e*, 12*f* of the guiding members 11, 12, respectively, and the separation position (FIG. 19 (B)) where the passage 11*c*1 is open. The lower sides 11*e*, 19*a* and 12*f* form a guiding section. The faulty weft Y4*a* caught by the protruded portion 11*d* is moved to the warp feeding side via the hook section 11*f* by driving the guiding section 11 to the driving position (FIG. 19 (C)).

Figure 20A:
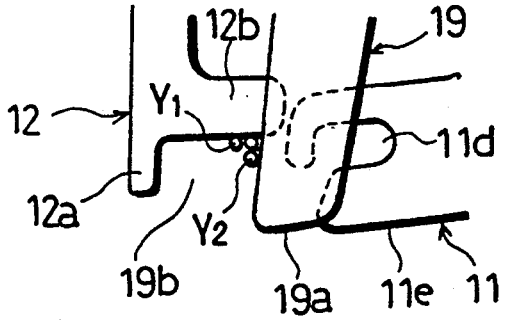
FIGS. 20(A), 20(B) and 20(C) are explanatory views illustrating still another modified example of the fourth embodiment.
Figure 20B:
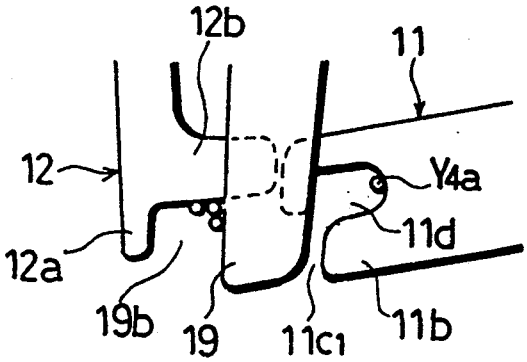
Figure 20C:
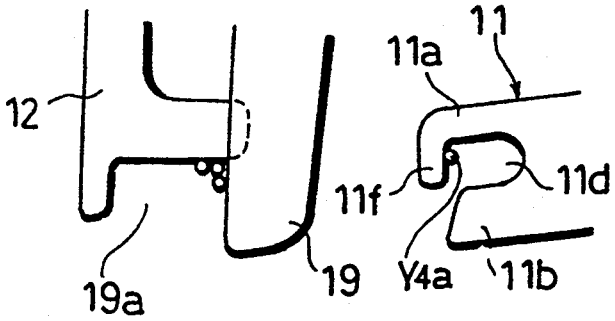

The guiding member 19 of the previous embodiment may be placed at the retraction position (FIG. 20 (A)) where the lower side 19*a* remains in a continuous state with the lower side 11*e* of the guiding member 11, and at the separating position (FIG. 20 (B)) located on the fabric winding side, where the passage 11*c*1 is formed. At this time, the recess 19*b* formed by the protruded portions 12*a*, 12*b* of the guiding member 12 and the guiding member 19 corresponds to the storage location. The faulty weft Y4*a* in the recess 11*d* may be moved to the warp feeding side by the hook section 11*f* when the guiding member 11 is moved to the driving position (FIG. 20 (C)).

In each of the aforementioned embodiment, the shapes of the guiding members 11, 12, 18 and 19 are not restricted to the shapes shown in the drawings as long as they can be moved relative to each other so as to form a prescribed storage area, guiding section, and blocking section and when required, a positioning section, and a driving section. Although the guiding member 12 is moved to the separating position to form the passage 11*c*1 between the guiding members 11 and 12, instead of the guiding member 12, it is permissible to move the guiding member 11 (for example, as shown in FIG. 3, FIG. 12 (B), FIG. 15 (B), FIG. 18 (B)). Likewise, as shown in FIG. 20 (B), when the passage 11*c*1 is formed, instead of the guiding member 19, it is permissible to move the guiding member 11. Further, whether the yarn guide 22 is to be rotated when it is moved from the retraction position to the action position may be selected arbitrarily.

The contents of the loom stop operation when a faulty weft insertion occurs and the pick finding operation of exposing the faulty weft Y4*a* in the shed after the loom stops are not always restricted to those explained above, but may instead be changed arbitrarily. For example, in order to perform the pick finding operation of the rapier loom, it is possible to reverse only the shedding motion by means of the pick finder instead of entirely reversing the loom. Thus, the required number of the reverse rotations of the shedding motion must only be equal to the number of the rotation by inertia until the loom stops. As for the hook 21, the yarn guide 22, the weft cutter 23 and the weft removing apparatus 30, the respective shapes and the operational sequences may be changed arbitrarily. For example, the hook 21 may be in the downward retraction position so as to push up only the weft Y4 which remains in a continuous state with the faulty weft Y4*a* to the vicinity of the weft removing apparatus 30. Further, instead of the hook 21, it is permissible to suck the weft Y4 up to the weft removing apparatus 30 by an appropriate suction pipe.

As described above, according to the present invention, multiple guiding members which are mutually moved relative to each other on the fabric insertion side are disposed to form the storage area, the guiding section and the blocking section. The storage section stores properly inserted wefts and the blocking section blocks the faulty weft from being moved to the storage section via the guiding section. Consequently, the rear portion of the faulty weft can be separated from the other properly inserted wefts and the weft removing apparatus is capable of capturing only the separated faulty weft and removing it securely from the shed.

When the guiding member forms the driving section, the driving section moves the separated faulty weft more to the warp feeding side, pulling the faulty weft in the shed widely apart from the cloth fell. Thus, when the faulty weft is removed, the required amount of tension may be minimized, so that there is no possibility that the faulty weft is cut, and thus the faulty weft can be removed more smoothly.

What is claimed is:

1. A faulty weft separating apparatus in a rapier loom for multiple colors in which multiple guiding members which are moved relative to each other are adapted to be disposed between an end of an insertion side of a fabric and a weft removing apparatus, a set of said combined guiding members including; a storage area in which an inserted weft is stored to be positioned at a specified position; a guiding section adapted to introduce said inserted weft to said storage area when said inserted weft is beaten by a reed; and a blocking section which blocks a rear portion of a faulty weft from being moved to said storage location when a faulty weft insertion occurs.

2. A faulty weft separating apparatus according to claim 1, wherein said set of said guiding members further includes a positioning section which positions the rear portion of said faulty weft caught by said blocking section on a warp feeding side.

3. A faulty weft separating apparatus according to claim 2, wherein said set of said guiding members include means for moving the rear portion of said faulty weft caught by said positioning section to the warp feeding side to separate said faulty weft from a cloth fell.

4. A faulty weft separating apparatus according to claim 1, wherein said set of said guiding members include means for moving the rear portion of said faulty weft caught by said blocking section to a warp feeding side to separate said faulty weft from a cloth fell.

5. A faulty weft separating apparatus in a rapier loom for multiple colors comprising:

a first guiding member having an indentation which is located in the vicinity of a cloth fell and open to said cloth fell, a protruded portion formed at a downward position so it remains in a continuous state with said indentation and, a guiding section extending from a bottom of said protruded portion to a warp feeding side so it remains in a continuous state with said protruded portion; and a second guiding member which is located at a waiting position for blocking an opening of said indentation when a weft is inserted properly and forming a storage section which catches and stores inserted wefts, wherein, when a faulty weft insertion occurs, any one of said first and second guiding members is moved to a separating position where the blocking of the opening of said indentation is prevented and a faulty weft to be beaten by the reed is introduced into said indentation so as to separate said faulty weft from normal wefts.

6. A faulty weft separating apparatus according to claim 5, in which a hook section is formed at said protruded portion of said first guiding member on an upper side of said indentation of said first guiding member so that said protruded portion remains in a continuous state with the indentation of said first guiding member, and after said faulty weft is separated said second guiding member having said indentation is moved to the warp feeding side so as to catch said faulty weft on said hook section and separate said faulty weft from the cloth fell.

7. A faulty weft separating apparatus in a rapier loom for multiple colors comprising;

a first guiding member having a storage area in which an indentation open to a cloth fell in the vicinity of said cloth fell is formed for storing inserted wefts, a protruded portion formed at a downward position so it remains in a continuous state with said storage area and a guiding section extending from a bottom of said protruded portion to a warp feeding side so it remains in a continuous state with said protruded portion; and a second guiding member which is located at a waiting position which is above or below said first guiding member when a weft is inserted properly, said second guiding member comprises means for catching a faulty weft moved along said guiding section when said faulty weft is beaten by a reed, and means for moving to a separating position for separating the faulty weft from the other wefts.

8. A faulty weft separating apparatus according to claim 7, wherein said moving means moves said second guiding member to the warp feeding side so as to catch said faulty weft and separate it from the cloth fell after said faulty weft is separated.

9. A faulty weft separating apparatus according to claim 7, including a fourth guiding member which, after said faulty weft that is beaten to be moved along said guiding section by the reed, is caught and separated, moves said faulty weft to the warp feeding side in order to separate said weft from the cloth fell.

10. A faulty separating apparatus in a rapier loom for multiple colors comprising;

a first guiding member having a storage area which is located in the vicinity of a cloth fell and open to said cloth fell to form a first indentation for storing inserted wefts, a first protruded portion formed at a bottom of said storage area so it remains in a continuous state with said storage area and a first guiding section extending from a bottom of said first protruded portion to a warp feeding side so it remains in a continuous state with said first protruded portion;

a second guiding member which is so arranged on a yarn feeding side relative to said first guiding member to provide for a specified gap between said first guiding member and said second guiding member, said second guiding member having a second indentation which is open to said first guiding member, a second protruded portion formed at a downward position so it remains in a continuous state with said second indentation of said second guiding member and a second guiding section extending from a bottom of said second protruded portion of said second guiding member to the warp feeding side so it remains in a continuous state with said second protruded portion of said second guiding member; and a third guiding member which is located at a waiting position between said first and second guiding members when a weft is inserted properly to interconnect said first and second guiding members, and which, when a faulty weft insertion occurs, is moved so that said gap appears between said first and second guiding members.

* * * * *